US008469330B2

(12) United States Patent
Adams et al.

(10) Patent No.: US 8,469,330 B2
(45) Date of Patent: Jun. 25, 2013

(54) SYSTEMS AND METHODS FOR SECURING OBJECTS TO VEHICLES

(75) Inventors: Timothy E. Adams, Allen, TX (US); James A. Pruett, Allen, TX (US); Christopher Moshenrose, Santa Barbara, CA (US)

(73) Assignee: Raytheon Company, Waltham, MA (US)

( * ) Notice: Subject to any disclaimer, the term of this patent is extended or adjusted under 35 U.S.C. 154(b) by 300 days.

(21) Appl. No.: 12/813,027

(22) Filed: Jun. 10, 2010

(65) Prior Publication Data

US 2011/0303817 A1 Dec. 15, 2011

(51) Int. Cl.
*F16M 13/00* (2006.01)

(52) U.S. Cl.
USPC ..... 248/580; 248/560; 248/594

(58) Field of Classification Search
USPC ..... 248/560, 575, 580, 592, 594, 274.1, 248/292.13, 297.11, 317, 900; 414/560, 563, 414/572, 462; 280/402, 404
See application file for complete search history.

(56) References Cited

U.S. PATENT DOCUMENTS

| | | | | |
|---|---|---|---|---|
| 2,475,239 A | | 7/1949 | Hambrick | 114/240 |
| 3,451,470 A | * | 6/1969 | Herrick | 180/54.1 |
| 3,848,508 A | | 11/1974 | Bullinger | 89/36 H |
| 3,905,200 A | * | 9/1975 | Ylinen | 405/175 |
| 4,274,791 A | * | 6/1981 | Moon | 414/563 |
| 4,383,807 A | * | 5/1983 | Bubik | 414/563 |
| 5,339,233 A | * | 8/1994 | Yang | 362/402 |
| 5,430,999 A | * | 7/1995 | Grant | 56/11.9 |
| 6,139,250 A | * | 10/2000 | Nolasco | 414/563 |
| 2006/0280584 A1 | * | 12/2006 | Spuzak et al. | 414/462 |

FOREIGN PATENT DOCUMENTS

DE 4011963 4/1990

OTHER PUBLICATIONS

International Search Report and Written Opinion; PCT/US2011/038660; pp. 10, Sep. 20, 2011.

* cited by examiner

*Primary Examiner* — Tan Le
(74) *Attorney, Agent, or Firm* — Thorpe North & Western LLP

(57) ABSTRACT

A system and method for securing objects to vehicles, wherein the system may include a first and a second standoff apparatus that may be configured to support an object. Each of the first standoff apparatus and second standoff apparatus may include a recoilable device and a connector for coupling the recoilable device to the object. The first standoff may also include an anchor coupled to the vehicle, a support arm coupled to the anchor, and a cable coupled to the support arm, wherein at least the cable supports the weight of the object. The recoilable device may be configured to flex in response to an impact on the object and return the object to a first original position in the absence of the impact.

16 Claims, 5 Drawing Sheets

SYSTEMS AND METHODS FOR SECURING OBJECTS TO VEHICLES

TECHNICAL FIELD

The present disclosure relates to vehicles, and in particular, systems and methods for securing objects to vehicles.

BACKGROUND

Vehicle racks for carrying cargo on the exterior of a vehicle take various forms and are widely known. Examples of such racks may include luggage racks, recreational equipment racks (e.g., bike racks, ski racks, etc.), tools racks, etc. Generally, the racks are secured to the vehicle via, for example, a hitch receiver provided at the rear of the vehicle or directly mounted to the roof, rear gate, doors, and/or other panels of the vehicle.

However, current vehicle racks have disadvantages. For example, if a vehicle rack is specifically designed to carry bicycles, these racks are commonly not adaptable for other loads. Therefore, a completely different vehicle rack would be required for each type of loads. Another drawback of current vehicle racks is the damages caused when the racks strike an obstacle (e.g., tree, brush, road signs, etc.). The rigid design of current vehicle racks causes parts of the racks to deform and/or break, leaving the rack unusable and/or the cargo unsecured during transport.

SUMMARY

The present disclosure provides techniques for securing objects to vehicles that substantially eliminates or reduces at least some of the disadvantages and problems associated with previous methods and systems.

In some embodiments, a system for securing an object to a vehicle is provided. The system may include a first and a second standoff apparatus that may be configured to support an object. In some embodiments, each of the first standoff apparatus and second standoff apparatus may include a recoilable device and a connector for coupling the recoilable device to the object. The first standoff may also include an anchor coupled to the vehicle, a support arm coupled to the anchor, and a cable coupled to the support arm, wherein at least the cable supports the weight of the object. In some embodiments, recoilable device may be configured to flex in response to an impact on the object and return the object to a first original position in the absence of the impact.

In other embodiments, an apparatus for securing an object to a vehicle is provided. The apparatus may include, a recoilable device, a connector for coupling the recoilable device to the object, an anchor coupled to the vehicle, a support arm coupled to the anchor, and a cable coupled to the support arm, wherein at least the cable supports the weight of the object. The recoilable device may be configured to flex in response to an impact on the object and return the object to a first original position in the absence of the impact.

The present disclosure provides systems and methods for an adaptable, flexible mount that secures various objects to vehicles. The system and method may accommodate various types of loads (e.g., objects) while minimizing an impact on the object and the mount when an obstacle strikes Other technical advantages will be readily apparent to one skilled in the art from the following figures, descriptions, and claims. Moreover, while specific advantages have been enumerated above, various embodiments may include all, some or none of the enumerated advantages.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1A through 2C wherein like numbers are used to indicate like and corresponding parts.

Figure 1A:
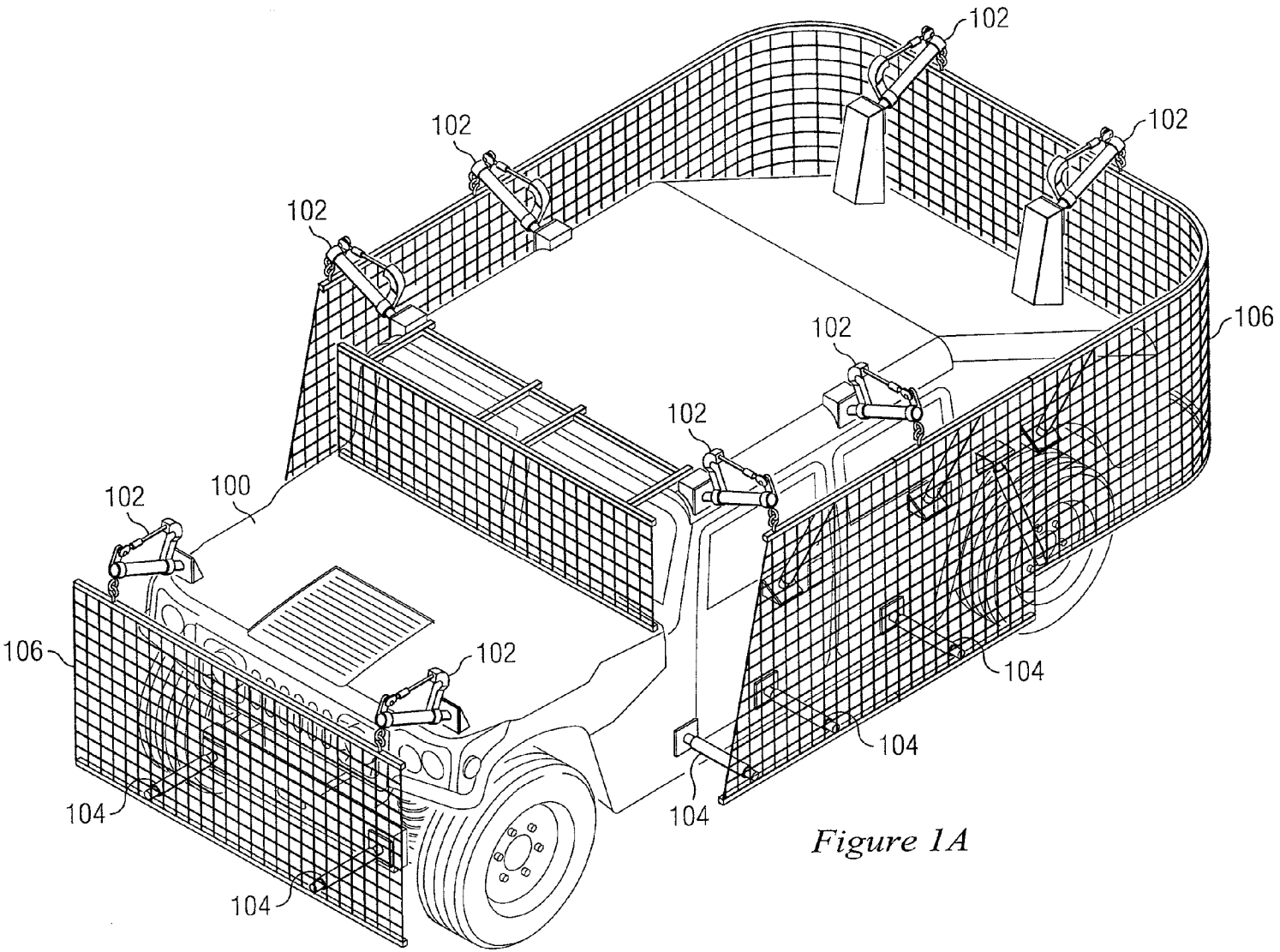
FIGS. 1A and 1B illustrate an example vehicle with multiple standoff configured to secure one or more objects to the vehicle, in accordance with certain embodiments of the present disclosure.
Figure 1B:
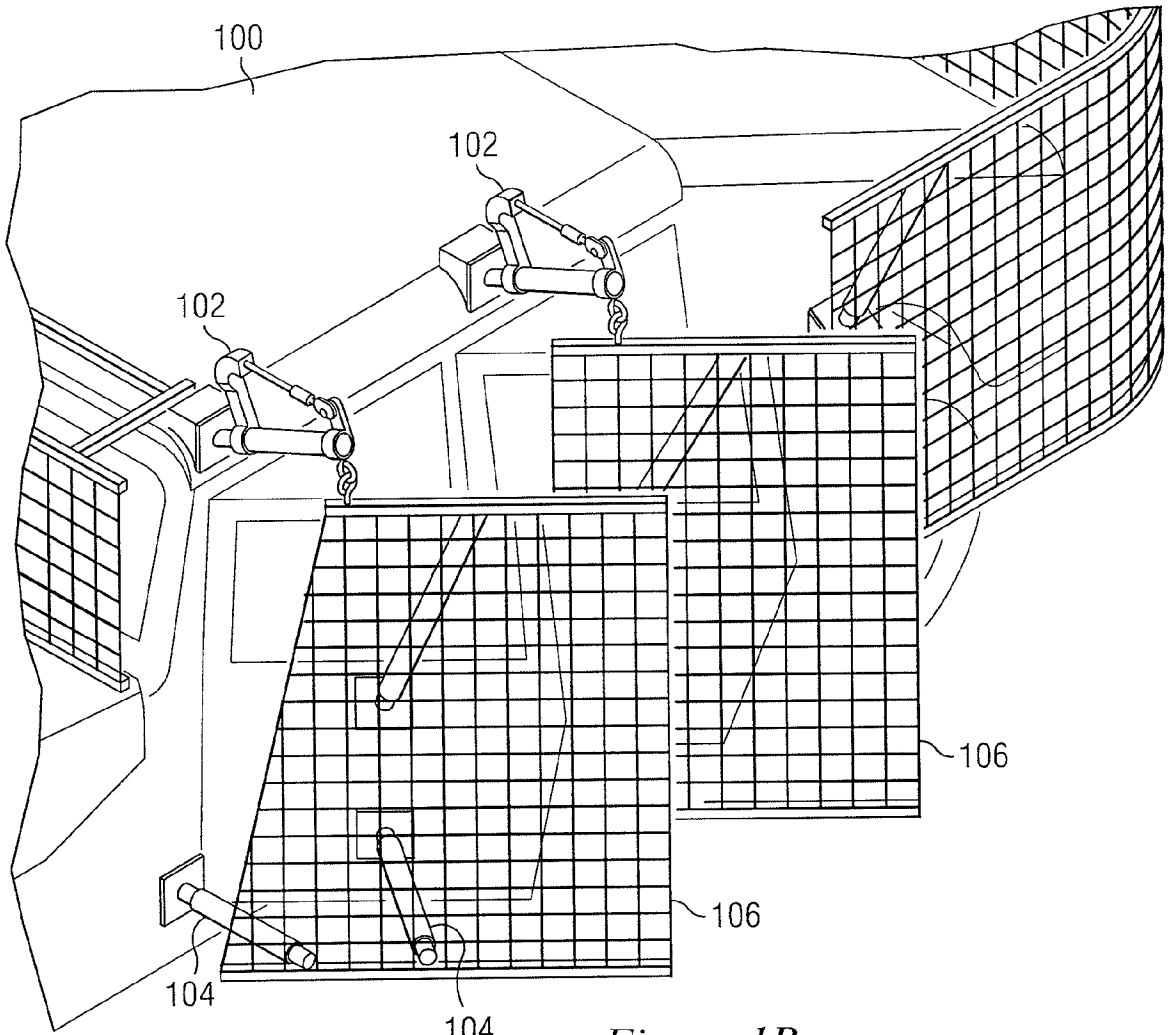

FIGS. 1A and 1B illustrate an example vehicle 100 with multiple standoffs configured to secure one or more objects to the vehicle, in accordance with certain embodiments of the present disclosure. For purposes of this disclosure, vehicle 100 may include any device or structure for transporting people and/or objects. In some embodiments, vehicle 100 may be a self-propelled vehicle. In other embodiments, vehicle 100 may be motorized vehicle or a vehicle being towed by animals or an engine.

Example vehicles may include, but is not limited to, land vehicles (e.g., cars, bicycles, motorcycles, trains, tractors, military vehicles, emergency response vehicles, etc.), watercraft vehicles (e.g., boats, rafts, ships, barges, submarines, etc.), and/or aircraft vehicles (e.g., helicopters, airplanes, hot air balloons, etc.).

Standoff 102 and 104 may be coupled to vehicle 100 and may be configured to secure one or more objects to vehicle 100. The objects may include, for example, armor, camouflage, sensors, mirrors, lights, equipment (e.g., ladders, tools, emergency carriers, ropes, nets, etc.), solar panels, traffic signs, and/or other objects that may need to be transported on the exterior of a vehicle. As an example, FIGS. 1A and 1B illustrate standoff 102 and 104 securing a netting around vehicle 100. The netting may serve to repel rocket propelled grenades (RPGs) or other similar artillery. However, any suitable object(s) may be coupled to vehicle 100 using standoffs 102 and/or 104. While FIGS. 1A and 1B show netting around most of vehicle 100, it is noted that the netting and standoff 102 and/or 104 may be coupled to any suitable portions of vehicle 100. Additionally, standoff 102 and/or 104 may secure multiple objects on vehicle 100. For example, as shown in FIG. 1B, standoff 102 and/or 104 may secure multiple nettings panels on vehicle 100. Each netting panel may be secured to an entry or opening of the vehicle, allowing access to the entry or opening. It is noted that FIGS. 1A and 1B illustrate one example of standoff 102 and 104 used to secure objects to a vehicle. Other suitable vehicles and objects may also be used based on the implementation.

In some embodiments, standoff 102 and/or 104 may provide a flexible mount that returns to an original position after being struck by obstacles (e.g., trees, brush, road signs, etc.) during operation of the vehicle. In particular, standoff 102 and/or 104 may strike an obstacle, temporarily swing out of position, and subsequently spring back into the original position, which may minimize or eliminate the damage to the object and/or standoffs during the impact. In some embodiments, standoff 102 may be configured to support the weight of object 106 and standoff 104 may be configured to aid standoff 102 during an impact by moving object 106 towards the vehicle. Details of standoff 102 and 104 are described below.

Figure 2A:
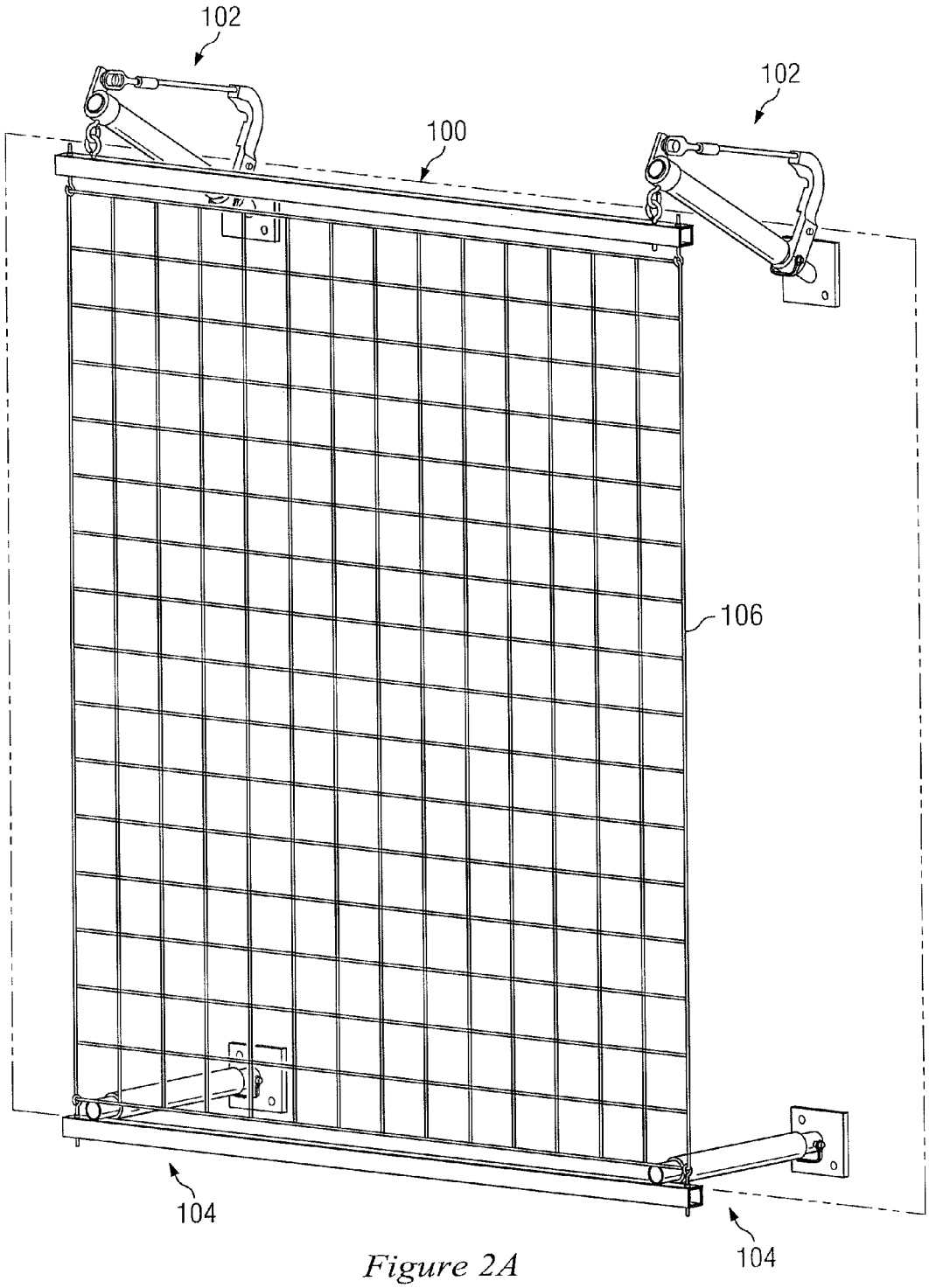
FIG. 2A illustrates standoffs securing an object to a vehicle in further detail, in accordance with certain embodiments of the present disclosure.
Figure 2B:
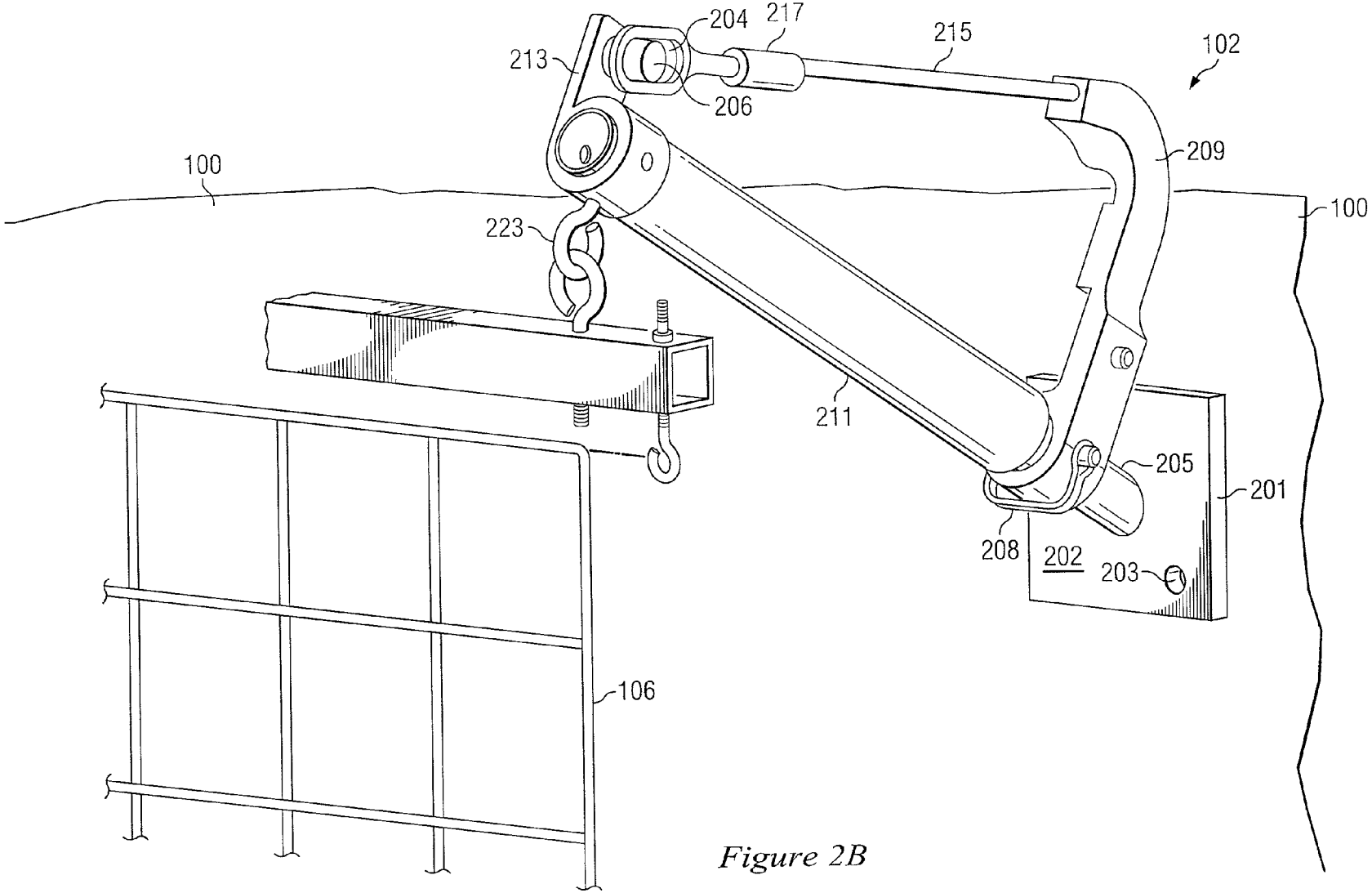
FIG. 2B illustrate an example supported standoff for securing an object to a vehicle, in accordance with certain embodiments of the present disclosure.
Figure 2C:
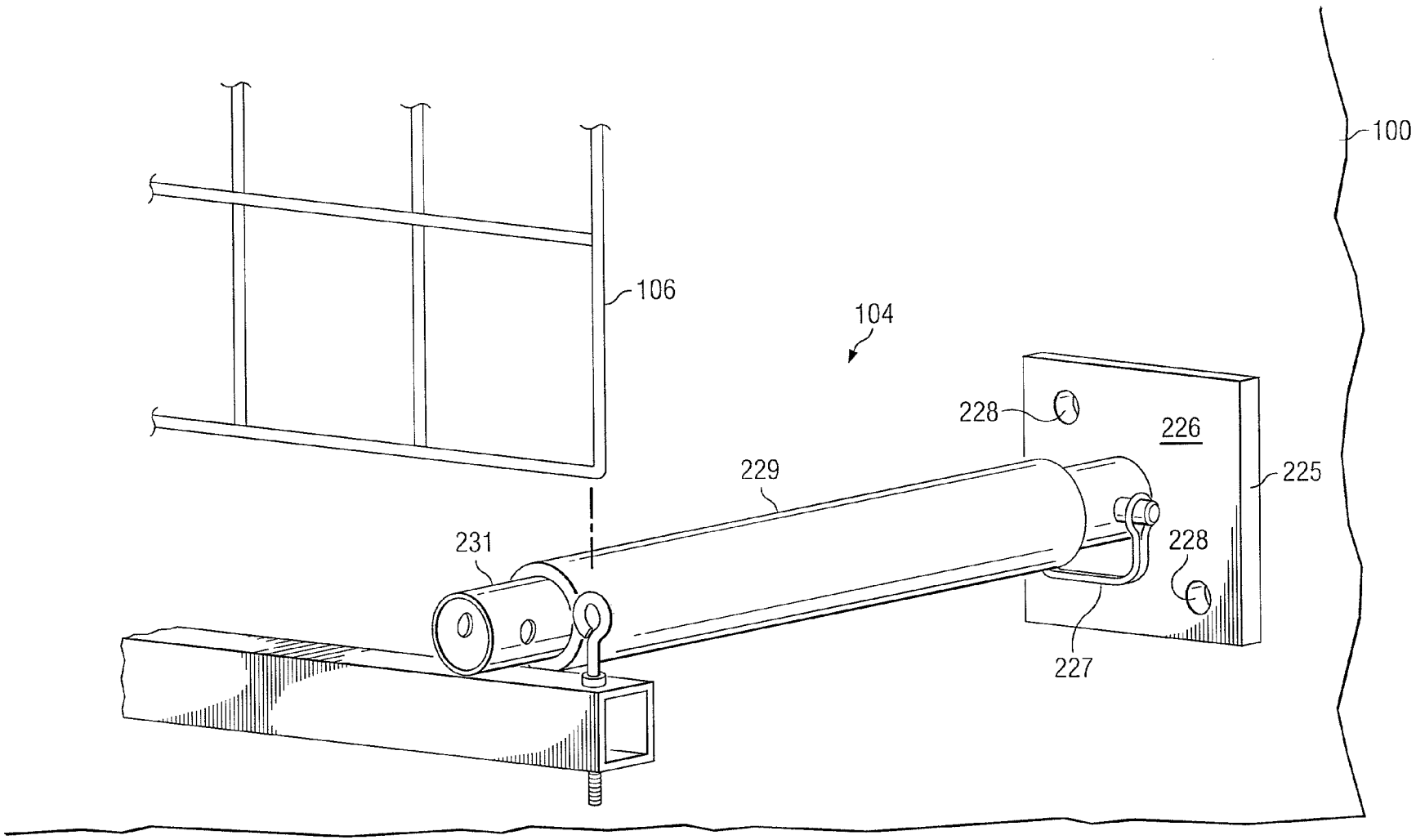
FIG. 2C illustrate an example unsupported standoff for securing an object to a vehicle, in accordance with certain embodiments of the present disclosure.

FIG. 2A illustrates standoff 102 and 104 securing object 106 to vehicle 100, in accordance with certain embodiments of the present disclosure. It is noted that while FIGS. 2A-2C illustrate object 106 as a netting, other objects may be secured to vehicle 100 using standoff 102 and/or 104. It is also noted that while FIG. 2A illustrates both standoffs 102 and 104, certain implementations may use only one type of standoff, either standoff 102 or standoff 104.

In some embodiments, one or more standoffs 102 may be positioned at a top portion of object 106 to support the weight of object 106 using a cable that is held taut across an end piece and a support arm. One or more standoffs 104 may be positioned at a bottom portion of object 106 and may aid standoff(s) 102 in moving object 106 during an impact. Once supported by standoff 102 and/or 104, object 106 may be spaced apart from vehicle 100 by an offset such that when object 106 comes into contact with an obstacle, standoff 102 and/or 104 may swing to one side and rebound back to an original position. The offset between object 106 and vehicle 100 may vary depending on the size, weight, and/or other factors of object 106.

In one embodiment, if an obstacle strikes object 106, standoff 102 and/or 104 may swing towards vehicle 100. For example, if an obstacle strikes object 106 from the right-hand side, standoff 102 and/or 104 may bend in the direction of arrow 110 and drawing object 106 closer to the vehicle, thereby minimizing the impact of the obstacle on object 106 and/or standoff 102 and 104. Once the obstacle has passed, standoff 102 and/or 104 may automatically reposition object 106 by swinging in the opposite direction of arrow 110. In some embodiments, standoff 102 and/or 104 may reposition the object to an original position, e.g., position of object 106 prior to the running into the obstacle. Details of standoff 102 and 104 are described below in FIG. 2B and 2C respectively.

FIG. 2B illustrates an example standoff 102 for securing object 106 to a vehicle 100, in accordance with certain embodiments of the present disclosure. In some embodiments, standoff 102 may be configured to support the weight of object 106. Standoff 102 may include anchor 201, support arm 209, recoilable device 211, end piece 213, cable 215, a coupler 217, and connector 223. In some embodiments, standoff 102 may be coupled to a top portion of object 106, although standoff 102 may couple to any portions of object 106 depending on the implementation.

Anchor 201 may be coupled to vehicle 100 via a base 202 and mounting holes 203. In some embodiments, bolts are screwed into mounting holes 203 to affix anchor 201. Alternatively, base 202 may be soldered or welded to vehicle 100 or other suitable attachments may be used. In some embodiments, base 202 may be integral to vehicle 100 and may be made of aluminum, carbon fiber, plastic, other metals or metal alloy, and/or compounds.

Anchor 201 may include a stanchion 205 that protrudes from anchor 201 and couples to support arm 209 via, for example, a male-female connector. Support arm 209 of standoff 102 may be configured to engage with recoilable device 211 to affix standoff 102 to vehicle 100. Support arm 209 may be made of a metal (e.g., aluminum, iron, etc.), a metal alloy, a plastic, a resin, and/or other combination of materials. Support arm 209 may also be a casting, molding, and/or machining. In some embodiments, support arm 209 may be shaped to work in association with cable 215 to support the weight of object 106. For example, support arm 209 may project in substantially an upright position to support the weight of object 106.

Anchor 201 may also include pin 208 that may be used to couple support arm 209 to anchor 201. Pin 208 may be a quick-release pin that may allow standoff 102 to quickly be removed from anchor 201. In the same or alternative embodiments, anchor 201 may include a bolt that may be used to couple support arm 209 to anchor 201.

Recoilable device 211 may be coupled to support arm 209 and may be a non-compressible spring device, a rigid, yet flexible piece of rubber or similar material that bends and subsequently recoils. In some embodiments, recoilable device 211 may be configured to support some of the weight of the object 106 when object 106 is coupled to standoff 102. Once object 106 is secured to stanchion 102, recoilable device 211 may be configured to bend in response to hitting an obstruction in the direction impact. As object 106 is being struck by the obstruction, recoilable device 211 may draw object 106 closer to vehicle 100 and upon passing the obstruction, recoilable device 211 may rebound, hence returning object 106 to an original position.

End piece 213 of standoff 102 may be configured to couple to recoilable device 211 and may be configured to secure object 106 via, for example, connector 223. In some embodiments, end piece 213 may be made of a metal (e.g., aluminum, iron, etc.), a metal alloy, a plastic, a resin, and/or other combination of materials.

Cable 215 coupled to support arm 209 and end piece 213 may be configured to provide a tension for recoilable device 211 when secured to support arm 209 and end piece 213. In some embodiments, cable 215 may include one or more wires, ropes, chains or other material that may be held taut across support arm 209 and end piece 213, thereby supporting the weight of object 106. In some embodiments, cable 215 may be a tailgate cable, although other cables are contemplated.

It is noted that while FIG. 2B illustrates a cable, other components may also be used. For example, a rigid arm with pivots, a flexible rod, and/or other components are contemplated.

Coupler 217 may be any component or device configured to couple cable 215 to end piece 213. In some embodiments, coupler 217 may be integral with cable 215. Alternatively, coupler 217 may be a separate component that attaches to cable 215. In some embodiments, coupler 217 may include a tab 204 (e.g., a metal eyelet) for attaching to an associated stanchion 206 protruding from end piece 213. Stanchion 206 and tab 204 may include a "slide and lock" configuration where tab 204 is hooked on to stanchion 206 and placed into a secure position by sliding the tab into a locking position. In the same or alternative embodiments, coupler 217 may include a tab that is secured onto end piece 213 via a bolt (e.g., tightened onto end piece 213 with a ratchet).

Connector 223 may any device or apparatus configured to couple end piece 213 to object 106. As shown in FIG. 2A, connector 223 includes multiple eye hooks, e.g., one eye hook is coupled to end piece 213 and the other eye hook is coupled to object 106.

In other embodiments, connector 223 may include a ball and socket, multiple snaps, hooks, or other similar device or apparatus configured to couple object 106 to standoff 102.

In operation, once standoff 102 is anchored to vehicle 100, standoff 102 may be used to support object 106, e.g., support the weight of object 106. In some embodiments, the length of standoff 102 may allow object 106 to be spaced apart from vehicle 100 by an offset such that when object 106 comes into contact with an obstacle, standoff 102 may swing to one side in the direction of impact. When vehicle 100 passes the obstacle, standoff 102 may automatically recoil or rebound back to an original position.

In some embodiments, standoff 102 may be used to secure object 106 to vehicle 100, where standoff 102 may be coupled to a top and bottom portion of object 106. In other embodiments, standoff 102 may be paired with standoff 104 to secure object 106. For example, one or more standoff 102 may be used to secure a top portion of object 106 while one or more standoff 104 may be used to secure a bottom portion of the object.

FIG. 2C illustrates an example standoff 104 for securing object 106 to a vehicle 100, in accordance with certain embodiments of the present disclosure. Standoff 104 may include anchor 225, pin 227, recoilable device 229, and connector 231.

Anchor 225 may be coupled to vehicle 100 via a base 226 and mounting holes 228. In some embodiments, anchor 225 may be affixed to vehicle 221 via bolts coupled to mounting holes 203, soldered or welded to vehicle 100, or via other suitable attachments. In other embodiments, base 226 may be integral to vehicle 100.

Anchor 225 may also include pin 227 that may be used to quickly remove standoff 104 from anchor 225. Pin 227 may be a quick-release pin that may allow the device to quickly be removed from anchor 225.

A recoilable device 229 may be an apparatus coupled to anchor 225. In some embodiments, recoilable device 229 may be a non-compressible spring device, a rigid, yet flexible piece of rubber or similar material that bends and subsequently recoils. In some embodiments, recoilable device 229 may be configured to minimize or reduce the impact on object 106. As object 106 is being struck by the obstruction, recoilable device 229 may draw object 106 closer to the vehicle. Upon passing the obstruction, recoilable device 229 may rebound, hence returning object 106 to an original position.

Connector 231 may any apparatus configured to couple standoff 104 to object 106. In some embodiments, connector 231 may be a ball and socket connector, hooks (e.g., hook and loop connectors, eye hooks, etc.), snaps, nuts and bolts, Velcro, latches, hinges, and/or other suitable connectors that may couple standoff 104 to object 106.

In operation, after object 106 is secured to standoff 104, which is secured to vehicle 100 via anchor 225, standoff 104 may reposition object 106 during an impact. For example, if an obstruction strikes object 106, recoilable device 229 may bend in the direction of impact, moving object 106 closer to vehicle 100. Once vehicle 100 passes the obstruction, recoilable device 229 may automatically rebound, returning object 106 to an original position, e.g., the position prior to the impact.

Using the methods and systems disclosed herein, problems associated with conventional approaches to secure objects to vehicles are reduced or eliminated. For example, standoff 102 and/or 104 may be used to secure any type of objects to a vehicle using connectors 223 and 231 respectively, thus providing a system that is adaptable to any loads and vehicle types. Depending on the object (e.g., shape, size, weight, etc.) and the vehicle type (e.g., aircraft, motor vehicle, etc.), an appropriate connector coupled to standoff 102 and/or 104 may be used to safely secure the objects.

In addition, recoilable devices 211 and 229 may provide some flexibility to reduce the impact of an obstacle and damage to standoff 102 and/or 104. For example, recoilable devices 211 and/or 229 may be configured to bend in the direction of impact allowing the obstacle to pass with minimal or no damage to standoff 102 and/or 104. Over time, to maintain standoff 102 and/or 104, recoilable devices 211 and 229 may be easily replaced compared to convention vehicle racks that need full rack replacement.

Although the figures and embodiments disclosed herein have been described with respect to information handling systems, it should be understood that various changes, substitutions and alternations can be made herein without departing from the spirit and scope of the disclosure as illustrated by the following claims.

What is claimed:

1. A system for securing an object to a vehicle, the system comprising:

a first standoff configured to support an upper portion of an object and a second standoff configured to support a lower portion of the object, wherein each of the first standoff and second standoff comprises:

an anchor coupled to the vehicle;

a recoilable device having a fixed end coupled to the anchor and a free end opposite the fixed end; and a connector for coupling the free end of the recoilable device to the object, wherein the recoilable device is configured to:

flex in response to an impact on the object; and rebound to return the object to a first original position in the absence of the impact; and wherein the first standoff further comprises:

a support arm having a lower end coupled between the anchor and the recoilable device, and an upper end extended upward from the lower end; and a cable coupled to the upper end of the support arm and in support of the free end of the recoilable device, wherein at least the cable supports the free end of the recoilable device under the weight of the object.

2. The system according to claim 1, wherein the cable is a tailgate cable.

3. The system according to claim 1, wherein the first standoff further comprises an end piece coupled to the free end of the recoilable device.

4. The system according to claim 3, wherein the cable is coupled to the end piece.

5. The system according to claim 1, wherein the first standoff is coupled to a top portion of the object and the second standoff is coupled to a bottom portion of the object.

6. The system according to claim 1, wherein to flex in response to an impact on the object comprising moving the object towards to the vehicle.

7. The system according to claim 1, wherein to flex in response to an impact comprising moving the object in the direction of the impact.

8. The system according to claim 1, wherein the recoilable device comprises a spring device.

9. The system according to claim 8, wherein the spring device comprises a non-compressible spring device.

10. The system according to claim 1, wherein the anchor comprises a stanchion and coupled to the support arm and extends upwards from the anchor.

11. An apparatus for securing an object to a vehicle, the apparatus comprising:

an anchor coupled to the vehicle;

a recoilable device having a fixed end coupled to the anchor and a free end opposite the fixed end;

a connector for coupling the free end of the recoilable device to the object, wherein the recoilable device is configured to:

flex in response to an impact on the object; and rebound to return the object to a first original position in the absence of the impact;

a support arm having a lower end coupled between the anchor and the recoilable device, and an upper end extended upward from the lower end; and a cable coupled to the upper end of the support arm and in support of the free end of the recoilable device, wherein at least the cable supports the free end of the recoilable device under the weight of the object.

12. The apparatus according to claim 11, wherein the cable is a tailgate cable.

13. The apparatus according to claim 11, wherein to flex in response to an impact on the object comprising moving the object relative to the vehicle.

14. The apparatus according to claim 11, wherein the recoilable device comprises a spring device.

15. The apparatus according to claim 14, wherein the spring device comprises a non-compressible spring device.

16. The apparatus according to claim 11, wherein the anchor comprises a stanchion coupled to the support arm.

* * * * *